US009935374B2

(12) United States Patent
Chang

(10) Patent No.: US 9,935,374 B2
(45) Date of Patent: Apr. 3, 2018

(54) MULTI-BAND ANTENNA

(71) Applicant: ARCADYAN TECHNOLOGY CORPORATION, Hsinchu (TW)

(72) Inventor: Jing-Teng Chang, Xinfeng Township, Hsinchu County (TW)

(73) Assignee: Arcadyan Technology Corporation, Hsinchu (TW)

( * ) Notice: Subject to any disclaimer, the term of this patent is extended or adjusted under 35 U.S.C. 154(b) by 112 days.

(21) Appl. No.: 15/226,668

(22) Filed: Aug. 2, 2016

(65) Prior Publication Data

US 2017/0149142 A1 May 25, 2017

(30) Foreign Application Priority Data

Oct. 5, 2015 (TW) ..... 104132685 A

(51) Int. Cl.

| | |
|---|---|
| ***H01Q 1/38*** | (2006.01) |
| ***H01Q 13/10*** | (2006.01) |
| ***H01Q 1/48*** | (2006.01) |
| ***H01Q 5/378*** | (2015.01) |
| ***H01Q 1/24*** | (2006.01) |

(52) U.S. Cl.

CPC ..... *H01Q 13/106* (2013.01); *H01Q 1/243* (2013.01); *H01Q 1/38* (2013.01); *H01Q 1/48* (2013.01); *H01Q 5/378* (2015.01)

(58) Field of Classification Search

CPC ..... H01Q 1/24; H01Q 1/38; H01Q 13/106; H01Q 5/378; H01Q 1/243

USPC ..... 343/700 MS

See application file for complete search history.

(56) References Cited

U.S. PATENT DOCUMENTS

| | | | | |
|---|---|---|---|---|
| 8,369,950 | B2 | 2/2013 | Rawat et al. | |
| 2006/0050002 | A1 | 3/2006 | Wang et al. | |
| 2009/0135087 | A1* | 5/2009 | Gummalla | H01P 3/02 343/909 |
| 2010/0265157 | A1* | 10/2010 | Yang | H01Q 9/0421 343/908 |
| 2012/0075154 | A1 | 3/2012 | Biglarbegian et al. | |
| 2012/0169555 | A1* | 7/2012 | Tsou | H01Q 5/364 343/749 |
| 2012/0274522 | A1* | 11/2012 | Ayatollahi | H01Q 1/243 343/745 |
| 2013/0088404 | A1* | 4/2013 | Ramachandran | H01Q 1/243 343/853 |
| 2015/0200448 | A1 | 7/2015 | Tsai et al. | |

* cited by examiner

*Primary Examiner* — Huedung Mancuso
(74) *Attorney, Agent, or Firm* — Innovation Counsel LLP

(57) ABSTRACT

A multi-band antenna includes a circuit board having an insulation dielectric layer, a first ground plane and an impedance matching circuit formed on a first plane of the circuit board, and a second ground plane formed on a second plane of the circuit board. A slot antenna radiation main body, formed at a location of the second ground plane and corresponding to the exposed part of the insulation dielectric layer, includes first and second radiation main bodies. The first radiation main body includes a first impedance matching part and a first resonance part. The second radiation main body includes a second impedance matching part and a second resonance part. The first resonance part includes a plurality of first bends, a first segment, and a second segment. The second resonance part includes a plurality of second bends, a third segment, and a fourth segment.

11 Claims, 6 Drawing Sheets

MULTI-BAND ANTENNA

This application claims the benefit of Taiwan application Serial No. 104132685, filed Oct. 5, 2015, the disclosure of which is incorporated by reference herein in its entirety.

TECHNICAL FIELD

The disclosure relates in general to a multi-band antenna.

BACKGROUND

The technology of wireless communication device has gained rapid growth in recent years. In a wireless communication device, the antenna transmits and/or receives wireless signals. However, antenna performance is crucial to the wireless communication device.

In order to improve the performance of the wireless communication device, antenna technology is gradually developed. Therefore, how to minimize antenna size without lowering antenna performance has become an important direction for the industries.

SUMMARY

The disclosure is directed to a multi-band antenna with reduced area and enhanced antenna performance.

According to one embodiment, a multi-band antenna is provided. The multi-band antenna includes a circuit board having an insulation dielectric layer, a first ground plane formed on a first plane of the circuit board, an impedance matching circuit formed on the first plane of the circuit board, and a second ground plane formed on a second plane of the circuit board. A part of the insulation dielectric layer is exposed from the first ground plane. A slot antenna radiation main body is formed at a location of the second ground plane corresponding to the exposed part of the insulation dielectric layer and includes a first radiation main body and a second radiation main body. The first radiation main body includes a first impedance matching part and a first resonance part, which are located on two relative sides of a projection block of the impedance matching circuit, respectively. The second radiation main body includes a second impedance matching part and a second resonance part, which are located on two relative sides of the projection block of the impedance matching circuit, respectively. The first resonance part includes a plurality of first bends, a first segment formed by a first continuous bend group of the first bends and having a first pattern, and a second segment formed by a second continuous bend group of the first bends and having a second pattern. The first pattern is differentiated from the second pattern. Each of the first and the second continuous bend groups includes at least five continuous first bends of the first bends. The second resonance part includes a plurality of second bends, a third segment formed by a third continuous bend group of the second bends and having a third pattern, and a fourth segment formed by a fourth continuous bend group of the second bends and having a fourth pattern. The third pattern is differentiated from the fourth pattern. Each of the third and the fourth continuous bend groups includes at least five continuous second bends of the second bends.

The above and other aspects of the invention will become better understood with regard to the following detailed description of the preferred but non-limiting embodiment (s). The following description is made with reference to the accompanying drawings.

Figure 1:
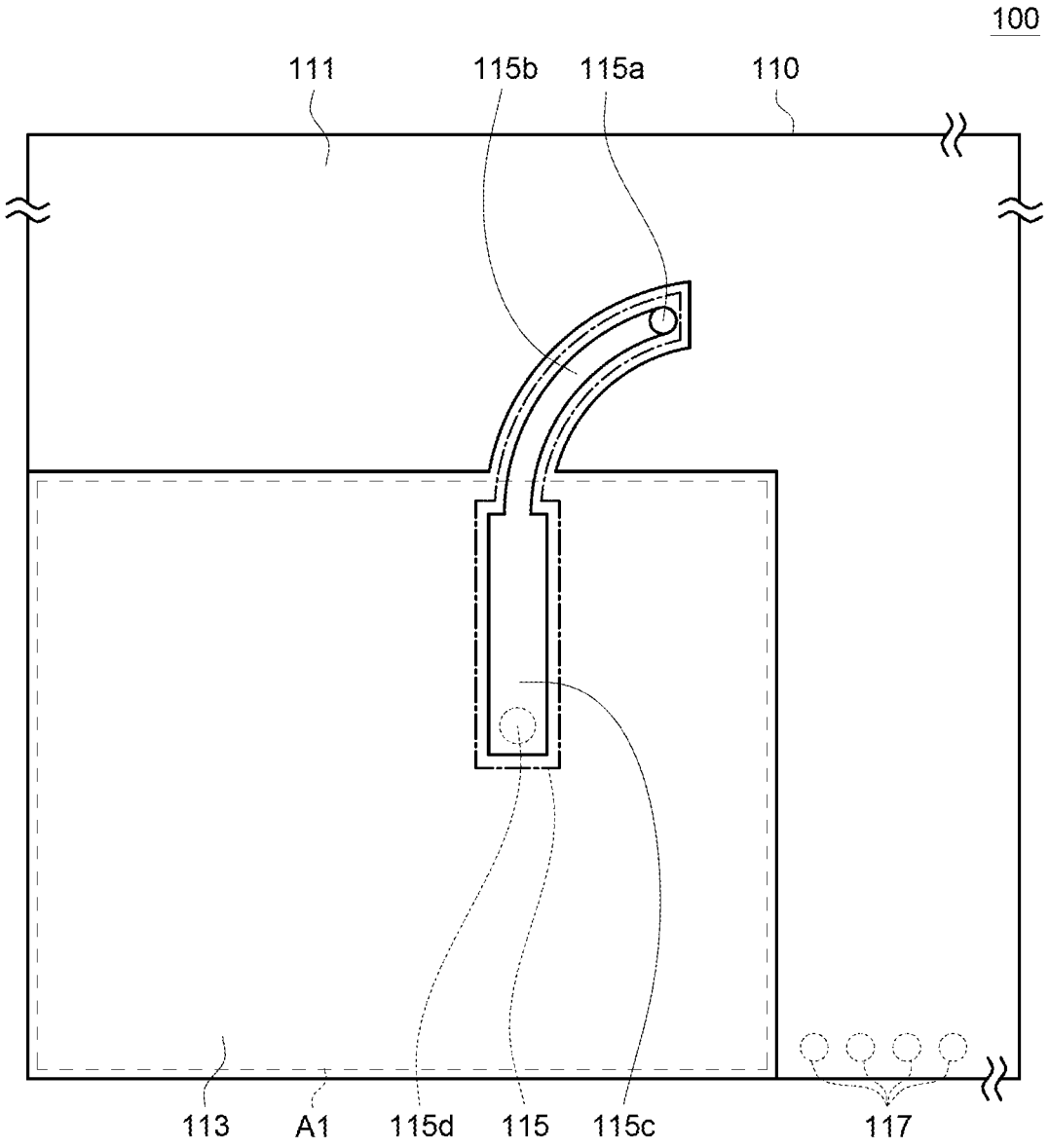
FIG. 1 shows a schematic diagram of a front side of a multi-band antenna according to an embodiment of the invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

DETAILED DESCRIPTION

Technical terms are used in the specification with reference to generally-known terminologies used in the technology field. For any terms described or defined in the specification, the descriptions and definitions in the specification shall prevail. Each embodiment of the present disclosure has one or more technical features. Given that each embodiment is implementable, a person ordinarily skilled in the art can selectively implement or combine some or all of the technical features of any embodiment of the present disclosure.

Referring to FIG. 1, a schematic diagram of a first plane (such as a front side) of a multi-band antenna according to an embodiment of the invention is shown. As indicated in FIG. 1, the multi-band antenna 100 includes a double-sided circuit board 110, a metal ground plane 111, an insulation dielectric layer 113 and an impedance matching circuit 115.

A first plane of the double-sided circuit board 110 forms a metal ground plane 111. The metal ground plane 111 is, for example, formed of copper foil. A part of the metal ground plane 111 is hollowed to expose the insulation dielectric layer 113 disposed under the metal ground plane 111. The hollowed part A1 of the metal ground plane 111 corresponds to a slot antenna radiation main body formed on the rear side of the double-sided circuit board 110 (illustrated in other drawing). That is, viewing from the direction of FIG. 1, the location of the slot antenna radiation main body on the rear side corresponds to a non-metal part.

Besides, the impedance matching circuit 115 is formed on a front side of the double-sided circuit board 110. To put it in greater details, the impedance matching circuit 115 is insulated from the metal ground plane 111, and includes a feed point 115*a*, a signal transmission line 115*b*, an impedance matching circuit main body 115*c* and a via hole 115*d*. The feed point 115*a*, the signal transmission line 115*b* and the impedance matching circuit main body 115*c* are connected to each other.

The shape of the impedance matching circuit 115 is as indicated in FIG. 1, but is not limited thereto. The signal transmission line 115*b* extends towards the metal ground plane 111 from the impedance matching circuit main body 115*c*.

When the multi-band antenna 100 transmits a wireless signal, the feed point 115*a* receives the wireless signal from a radio frequency circuit module (not illustrated), such that the wireless signal is transmitted to the slot antenna radiation main body on the rear side (not illustrated) through the signal transmission line 115*b* and the impedance matching circuit main body 115*c*. In general, the radio frequency circuit module can be formed on a front side of the double-sided circuit board 110.

When the multi-band antenna 100 receives the wireless signal, the wireless signal received by the slot antenna radiation main body on the rear side (not illustrated) can be transmitted to the radio frequency circuit module (not illustrated) through the impedance matching circuit main body 115*c*, the signal transmission line 115*b* and the feed point 115*a*.

The signal transmission line 115*b* is, for example, a micro-strip line or a coplanar waveguide (CPW).

The impedance matching circuit main body 115*c* is for adjusting impedance matching. In order to reduce the length of the impedance matching circuit main body 115*c*, in the present embodiment, the terminal end of the impedance matching circuit main body 115*c* further forms a via hole 115*d* penetrating the double-sided circuit board 110 and connecting to the metal ground plane on the rear side (not illustrated). The impedance matching circuit 115 is also electrically insulated from the metal ground plane on the rear side. That is, in the present embodiment, the via hole 115*d* is related to impedance matching, and the length adjustment of the via hole 115*d* benefits the adjustment of impedance matching.

Figure 2:
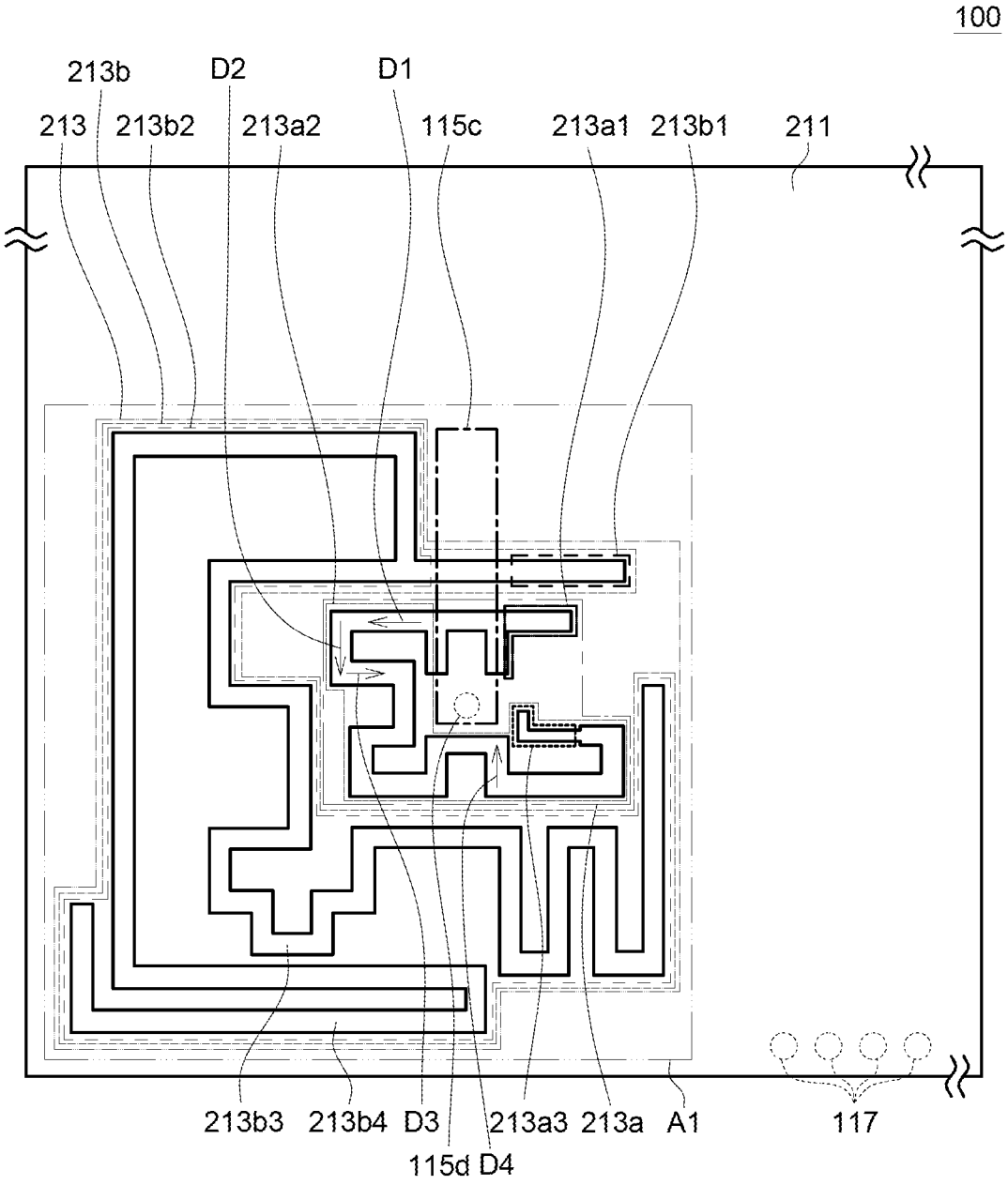
FIG. 2 shows a schematic diagram of a rear side of a multi-band antenna according to an embodiment of the invention.

Moreover, the metal ground plane 111 on the front side can also form at least a via hole 117 penetrating the double-sided circuit board 110 and connecting to the metal ground plane on the rear side. FIG. 2 illustrates several via holes 117, but the invention is not limited thereto.

Referring to FIG. 2, a schematic diagram of a rear side of a multi-band antenna 100 according to an embodiment of the invention. As indicated in FIG. 2, the rear side of the double-sided circuit board 110 further forms another metal ground plane 211.

A slot antenna radiation main body 213 is formed at a location of the metal ground plane 211 corresponding to a hollowed part A1 of the metal ground plane 111 of FIG. 1. Furthermore, the slot antenna radiation main body 213 is formed by way of hollowing and the hollowed pattern is illustrated in FIG. 2. That is, in the present embodiment, the slot antenna radiation main body 213 is formed by slots rather than a physical metal.

To clearly illustrate the position relationship between the impedance matching circuit main body 115*c* and the slot antenna radiation main body 213, the impedance matching circuit main body 115*c* and the via hole 115*d* of FIG. 1 are illustrated in FIG. 2 by dotted lines.

The slot antenna radiation main body 213 includes a first radiation main body 213*a* and a second radiation main body 213*b*. The first radiation main body 213*a* includes an impedance matching part 213*a*1 (used for impedance matching), a resonance part 213*a*2 (used for resonance) and a terminal end 213*a*3. The terminal end 213*a*3 can be regarded as a part of the resonance part 213*a*2. The impedance matching part 213*a*1 and the resonance part 213*a*2 of the first radiation main body 213*a* are located on two relative sides of a projection block of the impedance matching circuit 115, respectively.

The second radiation main body 213*b* includes an impedance matching part 213*b*1 (used for impedance matching) and a resonance part 213*b*2 (used for resonance). The resonance part 213*b*2 of the second radiation main body 213*b* includes a first part 213*b*3 and a second part 213*b*4. The impedance matching part 213*b*1 and the resonance part 213*b*2 of the second radiation main body 213*b* are located on two relative sides of the projection block of the impedance matching circuit 115, respectively.

The first radiation main body 213*a* forms a first resonance path for transmitting, illustratively but not restrictively, a wireless signal of 5 GHz. The terminal end 213*a*3 of the first radiation main body 213*a* can be used for impedance matching. In the present embodiment, the slimness of the terminal end of the first radiation main body 213*a* affects impedance matching. Or, the terminal end of the first radiation main body 213*a* can be slimmed to achieve better performance of impedance matching.

Besides, in the present embodiment, the first radiation main body 213*a* has, for example, 16 bends.

The first part 213*b*3 of the second radiation main body 213*b* is for transmitting, illustratively but not restrictively, a wireless signal slightly lower than that 2.4 GHz, and has, for example, 19 bends.

The second part 213*b*4 of the second radiation main body 213*b* is for transmitting, illustratively but not restrictively, a wireless signal slightly higher than 2.4 GHz, and has, for example, 7 bends. Since the resonance length of the first part 213*b*3 is slightly longer than that of the second part 213*b*4, the frequency of the wireless signal transmitted by the first part 213*b*3 is slightly lower than the frequency of the wireless signal transmitted by the second part 213*b*4.

In the embodiment illustrated in FIG. 2, after the wireless signal is fed from the feed point 115*a*, the wireless signal is firstly fed to the second radiation main body 213*b* (the resonance path for the wireless signal of 2.4 GHz) and then fed to the first radiation main body 213*a* (the resonance path for the wireless signal of 5 GHz).

Figure 3:
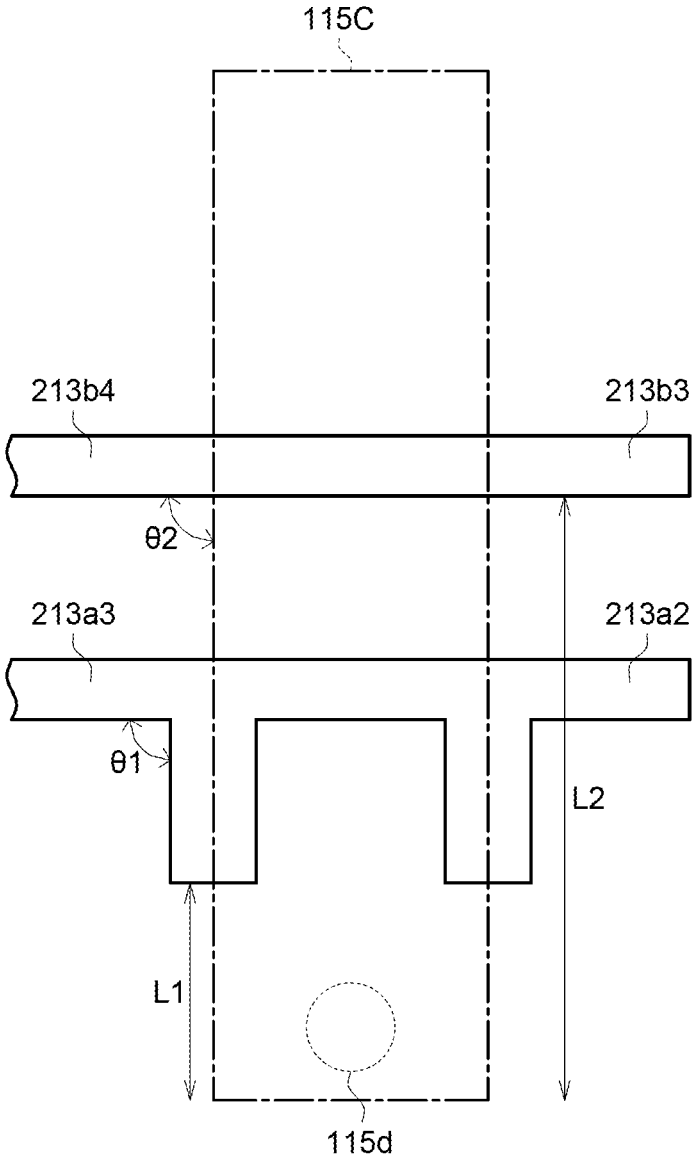
FIG. 3 shows a partial diagram of the multi-band antenna of FIG. 2 according to an embodiment of the invention.

A part of the impedance matching circuit main body 115*c* can be used for increasing the length of resonance path. To put it in greater details, in terms of the first radiation main body 213*a* (the resonance path for the wireless signal of 5 GHz), the first part L1 of the impedance matching circuit main body 115*c* (as indicated in FIG. 3) can be used for increasing the length of resonance path of the first radiation main body 213*a*. The first part L1 refers to the part of the impedance matching circuit main body 115*c* exceeding the first radiation main body 213*a*.

Similarly, in term of the second radiation main body 213*b* (the resonance path for the wireless signal of 2.4 GHz), the second part L2 of the impedance matching circuit main body 115*c* (as indicated in FIG. 3) can be used for increasing the length of resonance path of the second radiation main body 213*b*. The second part L2 refers to the part of the impedance matching circuit main body 115*c* exceeding the second radiation main body 213*b*.

As indicated in FIG. 2, using the impedance matching circuit main body 115*c* as a reference, the shorter part located on one side of the impedance matching circuit main body 115*c* (the right-hand side of FIG. 2) is referred as the impedance matching part 213*a*1 of the first radiation main body 213*a*, the shorter part is referred as the impedance matching part 213*a*1 of the first radiation main body 213*a*, and the remaining part of the first radiation main body 213*a* is referred as the resonance part 213*a*2 (used for resonance). That is, the first resonance path is formed by the resonance part 213*a*2 of the first radiation main body 213*a*.

As indicated in FIG. 2, using the impedance matching circuit main body 115*c* as a reference, the shorter part located on one side of the impedance matching circuit main body 115*c* (the right-hand side of FIG. 2) is referred as the impedance matching part 213*b*1 of the second radiation main body 213*b*, and the remaining part of the second radiation main body 213*b* is referred as the resonance part 213*b*2 (used for resonance). That is, the second resonance path is formed by the resonance part 213*b*2 of the second radiation main body 213*b*, and includes a first part 213*b*3 and a second part 213*b*4. The first part 213*b*3 can also be referred as the first resonance sub-path of the second resonance path (or the first resonance sub-part of the second resonance path). The second part 213*b*4 can also be referred as the second resonance sub-path of the second resonance path (or the second resonance sub-part of the second resonance path).

In the present embodiment of the invention, on the same resonance path (regardless being the first resonance path or the second resonance path), the pattern of the segment formed by 5 or more than 5 continuous bends (also referred as the first continuous bend group) is differentiated from the pattern of the segment formed by another 5 or more than 5 continuous bends (also referred as the second continuous bend group). Here, "being differentiated from" refers to being different, dissimilar and/or asymmetric. It does not matter whether the bends are repeated in the first continuous bend group and the second continuous bend group.

Furthermore, in the present embodiment, the signal travelling direction on each resonance path at least includes 4 directions. Let the first resonance path be taken for example. When the wireless signal is fed to the resonance part 213*a*2 of the first radiation main body 213*a*, the wireless signal travels to the terminal end 213*a*3 from the starting part of the resonance part 213*a*2 of the first radiation main body 213*a* in four directions. In other words, the wireless signal at least travels through first direction D1 (rightward direction), second direction D2 (downward direction), third direction D3 (leftward direction) and fourth direction D4 (upward direction) on the first resonance path (the said sequence is exemplified for an exemplary rather than a restrictive purpose). Similarly, when the wireless signal travels on the second resonance path, the wireless signal travels to the terminal end from the starting part of the resonance part 213*b*2 of the second radiation main body 213*b* in four directions. In other words, the wireless signal at least travels through first direction D1 (rightward direction), second direction D2 (downward direction), third direction D3 (leftward direction) and fourth direction D4 (upward direction) on the second resonance path (the said sequence is exemplified for an exemplary rather than a restrictive purpose).

Moreover, the first and the second resonance paths extend along at least 3 sides of the hollowed part A1. Let the second resonance path be taken for example. Viewing from the direction of FIG. 2, the second resonance path at least extends along the top side, the left side, and the bottom side and the right side of the hollowed part A1.

The second resonance path includes a first part 213*b*3 and a second part 213*b*4. As indicated in FIG. 2, the first part 213*b*3 is located at an inner circle, and the second part 213*b*4 is located at an outer circle, but the invention is not limited thereto. In other embodiments of the invention, the arrangement with the first part of the second resonance path being located at an outer circle and the second part being located at an inner circle is still within the spirit of the invention.

The angle of the bend is, illustratively but not restrictively, equivalent to 90° to reduce the area occupied by the slot antenna radiation main body 213.

FIG. 3 shows a partial diagram of the multi-band antenna 100 of FIG. 2 according to an embodiment of the invention. As indicated in FIG. 3, the angle θ1 formed between the first radiation main body 213*a* and the impedance matching circuit main body 115*c* is, illustratively but not restrictively, between 80°~100°. Similarly, the angle θ2 formed between the second radiation main body 213*b* and the impedance matching circuit main body 115*c* is, illustratively but not restrictively, between 80°~100°. Such angle design makes that the resonance path of the embodiment disclosed in FIG. 3 becomes denser and occupies less area.

Figure 4:
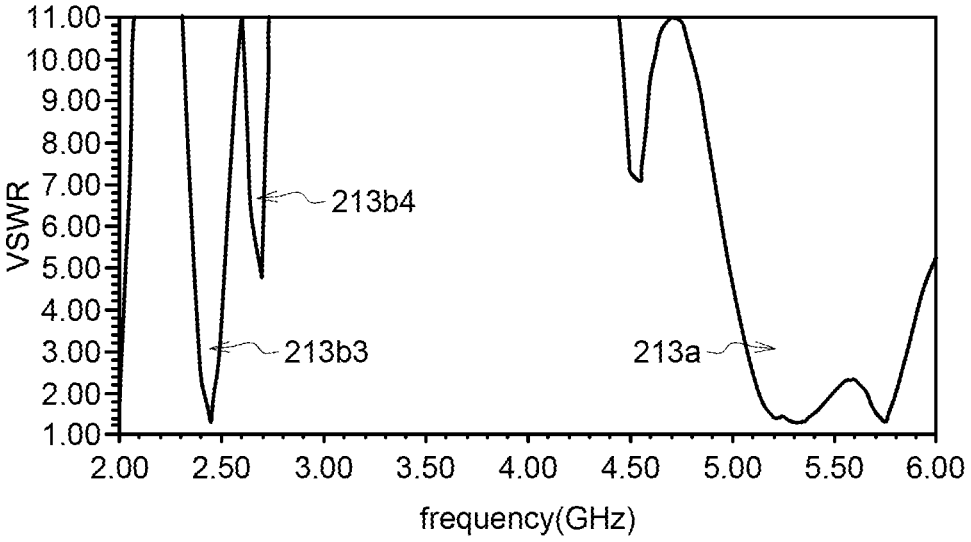
FIG. 4 shows a simulation diagram of the antenna of FIG. 2 according to an embodiment of the invention.

FIG. 4 shows a simulation diagram of the antenna of FIG. 2 according to an embodiment of the invention. As indicated in FIG. 4, the horizontal axis represents frequency, the vertical axis represents voltage standing wave ratio (VSWR); the first radiation main body 213*a* can resonate at a band of 5 GHz; the first part 213*b*3 of the second radiation main body 213*b* can resonate at a band slightly lower than 2.4 GHz; the second part 213*b*4 of the second radiation main body 213*b* can resonate at a band slightly higher than 2.4 GHz. As indicated in FIG. 3, no matter the frequency of the wireless signal is at 5 GHz or 2.4 GHz, the value of VSWR is satisfactory, this implies that the performance of the multi-band antenna 100 of the embodiment disclosed in FIG. 3 is indeed excellent.

It can be known from FIGS. 2-4 and the above descriptions, in comparison to conventional antenna, the multi-band antenna of the embodiment disclosed in FIG. 3 indeed occupies less area and produces better antenna performance.

Figure 5:
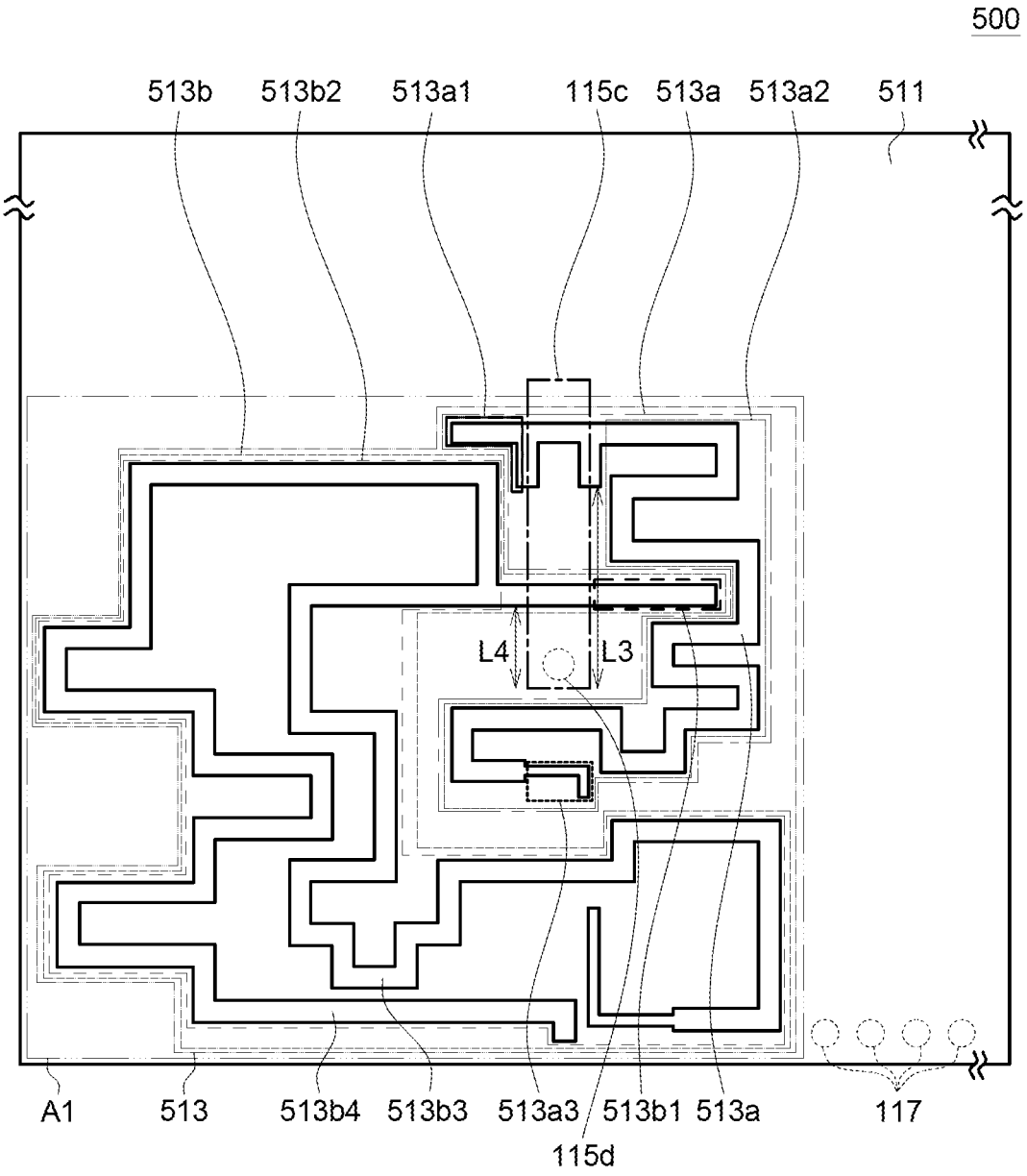
FIG. 5 shows a schematic diagram of a rear side of a multi-band antenna according to another embodiment of the invention.

Referring to FIG. 5, a schematic diagram of a rear side of a multi-band antenna 500 according to another embodiment of the invention is shown. As indicated in FIG. 5, a metal ground plane 511 is formed on a rear side of the double-sided circuit board of the multi-band antenna 500 (not illustrated).

A slot antenna radiation main body 513 is formed at a location of the metal ground plane 511 corresponding to a hollowed part A1 of the metal ground plane 111 of FIG. 1. Furthermore, the slot antenna radiation main body 513 is formed by way of hollowing and the hollowed pattern is illustrated in FIG. 5. That is, in the present embodiment, the slot antenna radiation main body 513 is formed by slots rather than a physical metal.

To clearly illustrate the position relationship between the impedance matching circuit main body 115*c* and the slot antenna radiation main body 513, the impedance matching circuit main body 115*c* and the via hole 115*d* of FIG. 1 are illustrated in FIG. 2 by dotted lines.

The slot antenna radiation main body 513 includes a first radiation main body 513*a* and a second radiation main body 513*b*. The first radiation main body 513*a* includes an impedance matching part 513*a*1 (used for impedance matching), a resonance part 513*a*2 (used for resonance) and a terminal end 513*a*3. The terminal end 513*a*3 can be regarded as a part of the resonance part 513*a*2.

The second radiation main body 513*b* includes an impedance matching part 513*b*1 (used for impedance matching) and a resonance part 513*b*2 (used for resonance). The resonance part 513*b*2 of the second radiation main body 513*b* includes a first part 513*b*3 and a second part 513*b*4.

The first radiation main body 513*a* forms a first resonance path for transmitting, illustratively but not restrictively, a wireless signal of 5 GHz. The terminal end 513*a*3 of the first radiation main body 513*a* can be used for impedance matching. In the present embodiment, the slimness of the terminal end of the first radiation main body 513*a* affects impedance matching. Or, the terminal end of the first radiation main body 513*a* can be slimmed to achieve better performance of impedance matching.

Besides, in the present embodiment, the first radiation main body 513*a* has, for example, 21 bends.

The first part 513*b*3 of the second radiation main body 513*b* is for transmitting, illustratively but not restrictively, a wireless signal slightly lower than 2.4 GHz, and has, for example, 17 bends.

The second part 513*b*4 of the second radiation main body 513*b* is for transmitting, illustratively but not restrictively, a wireless signal slightly higher than 2.4 GHz, and has, for example, 17 bends. Since the resonance length of the first part 513*b*3 is lightly longer than that of the second part 513*b*4, the frequency of the wireless signal transmitted by the first part 513*b*3 is slightly lower than the frequency of the wireless signal transmitted by the second part 513*b*4.

In the embodiment illustrated in FIG. 5, after the wireless signal is fed from the feed point 115*a*, the wireless signal is firstly fed to the first radiation main body 513*a* (the resonance path for the wireless signal of 5 GHz) and then fed to the second radiation main body 513*b* (the resonance path for the wireless signal of 2.4 GHz).

A part of the impedance matching circuit main body 115*c* can be used for increasing the length of resonance path. To put it in greater details, in terms of the first radiation main body 513*a* (the resonance path for the wireless signal of 5 GHz), the third part L3 of the impedance matching circuit main body 115*c* can be used for increasing the length of resonance path of the first radiation main body 513*a*. The third part L3 refers to the part of the impedance matching circuit main body 115*c* exceeding the first radiation main body 513*a*.

Similarly, in term of the second radiation main body 513*b* (the resonance path for the wireless signal of 2.4 GHz), the second part L4 of the impedance matching circuit main body 115*c* (as indicated in FIG. 3) can be used for increasing the length of resonance path of the second radiation main body 513*b*. The second part L2 refers to the part of the impedance matching circuit main body 115*c* exceeding the second radiation main body 513*b*.

The first radiation main body 513*a* can be divided into an impedance matching part 513*a*1 (used for impedance matching) and a resonance part 513*a*2 (used for resonance).

As indicated in FIG. 5, using the impedance matching circuit main body 115*c* as a reference, the shorter part located on one side of the impedance matching circuit main body 115*c* (the left-hand side of FIG. 5) is referred as the impedance matching part 513*a*1 of the first radiation main body 513*a*, and the remaining part of the first radiation main body 513*a* is referred as the resonance part 513*a*2 (used for resonance). That is, the first resonance path is formed by the resonance part 513*a*2 of the first radiation main body 513*a*.

The second radiation main body 513*b* can also be divided into an impedance matching part 513*b*1 (used for impedance matching) and a resonance part 513*b*2 (used for resonance).

As indicated in FIG. 5, using the impedance matching circuit main body 115*c* as a reference, the shorter part located on one side of the impedance matching circuit main body 115*c* (the right-hand side of FIG. 5) is referred as the impedance matching part 513*b*1 of the second radiation main body 513*b*, and the remaining part of the second radiation main body 513*b* is referred as the resonance part 513*b*2 (used for resonance). That is, the second resonance path is formed by the resonance part 513*b*2 of the second radiation main body 513*b*, and includes a first part 513*b*3 and a second part 513*b*4.

In the present embodiment disclosed in FIG. 5, on the same resonance path regardless being the first resonance path or the second resonance path, the pattern of the segment formed by 5 or more than 5 continuous bends will not be the same, similar or symmetric with the pattern of the segment formed by another 5 or more than 5 continuous bends like the embodiment disclosed in FIG. 2. The details are omitted here.

Furthermore, in the present embodiment disclosed in FIG. 5, the signal travelling direction of each resonance path at least includes 4 directions like the embodiment disclosed in FIG. 2. The details are omitted here.

In FIG. 5, the first and the second resonance paths extend along at least 3 sides of the hollowed part A1 like the embodiment disclosed in FIG. 2. The details are omitted here.

In FIG. 5, the first part 213*b*3 is located at an inner circle and the second part 213*b*4 is located at an outer circle.

Similarly, the angle formed between the first radiation main body 513*a* and the impedance matching circuit main body 115*c* is, illustratively but not restrictively, between 80°~100°. The angle between the second radiation main body 513*b* and the impedance matching circuit main body 115*c* is, illustratively but not restrictively, between 80°~100°. Such angle design makes that the resonance path of the embodiment disclosed in FIG. 5 becomes denser and occupies less area.

Figure 6:
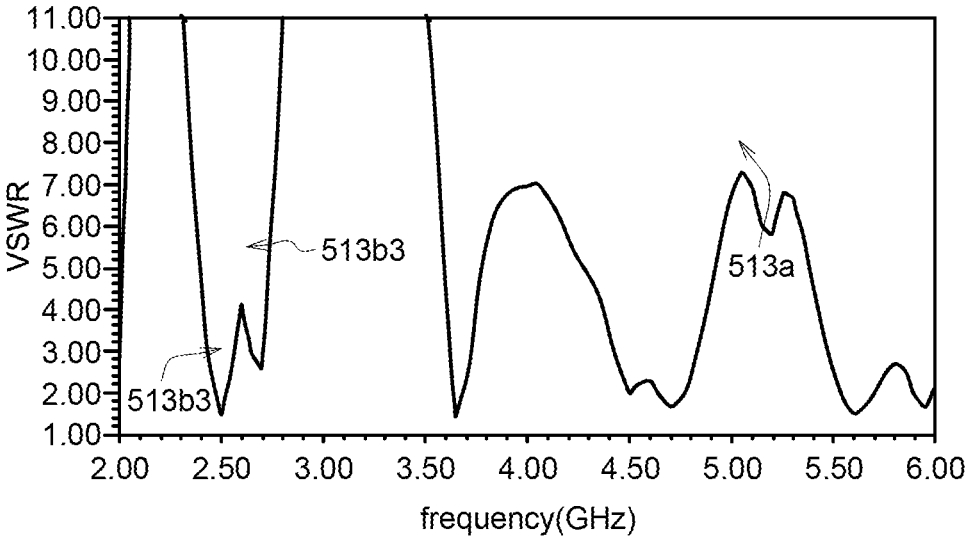
FIG. 6 shows a simulation diagram of the antenna of FIG. 5 according to an embodiment of the invention.

FIG. 6 shows a simulation diagram of the antenna of FIG. 5 according to an embodiment of the invention. As indicated in FIG. 6, the first radiation main body 513*a* can resonate at a band of 5 GHz; the first part 513*b*3 of the second radiation main body 513*b* can resonate at a band slightly lower than that 2.4 GHz; the second part 513*b*4 of the second radiation main body 513*b* can resonate at a band slightly higher than 2.4 GHz. As indicated in FIG. 6, no matter the frequency of the wireless signal is at the band of 5 GHz or the band of 2.4 GHz, the value of VSWR is satisfactory, this implies that the performance of the multi-band antenna 100 of the embodiment disclosed in FIG. 5 is indeed excellent.

It can be known from FIGS. 5-6 and the above descriptions, in comparison to conventional antenna, the multi-band antenna of the embodiment disclosed in FIG. 5 indeed occupies less area and produces better antenna performance.

Although in the above two embodiments, it is exemplified that the multi-band antenna resonates at two different frequency bands, but the invention is not limited thereto. In other feasible embodiments of the invention, the multi-band antenna can resonate at more than two different frequency bands.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A multi-band antenna, comprising:

a circuit board having an insulation dielectric layer;

a first ground plane formed on a first plane of the circuit board, wherein a part of the insulation dielectric layer is exposed from the first ground plane;

an impedance matching circuit formed on the first plane of the circuit board; and a second ground plane formed on a second plane of the circuit board, wherein a slot antenna radiation main body formed at a location of the second ground plane corresponding to the exposed part of the insulation dielectric layer;

wherein, the slot antenna radiation main body comprises a first radiation main body and a second radiation main body, the first radiation main body comprises a first impedance matching part and a first resonance part, which are located on two relative sides of the impedance matching circuit a projection block, respectively, the second radiation main body comprises a second impedance matching part and a second resonance part, which are located on two relative sides of the projection block of the impedance matching circuit, respectively, the first resonance part comprises a plurality of first bends, a first segment formed by a first continuous bend group of the first bends and having a first pattern, and a second segment formed by a second continuous bend group of the first bends and having a second pattern, the first pattern is differentiated from the second pattern, and each of the first and the second continuous bend groups comprises at least five continuous first bends of the first bends, and the second resonance part comprises a plurality of second bends, a third segment formed by a third continuous bend group of the second bends and having a third pattern, and a fourth segment formed by a fourth continuous bend group of the second bends and having a fourth pattern, the third pattern is differentiated from the fourth pattern, and each of the third and the fourth continuous bend group comprises at least five continuous second bends of the second bends.

2. The multi-band antenna according to claim 1, wherein, the impedance matching circuit comprises:

a feed point for receiving a wireless signal;

a signal transmission line connected to the feed point for transmitting the wireless signal;

an impedance matching circuit main body connected to the signal transmission line and used for impedance matching; and a first via hole located at a terminal end of the impedance matching circuit main body, wherein the first via hole penetrates the circuit board and is connected to the second ground plane of the second plane, the impedance matching circuit is electrically insulated from the first ground plane.

3. The multi-band antenna according to claim 1, wherein, the first ground plane forms at least a second via hole which penetrates the circuit board and is connected to the second ground plane of the second plane.

4. The multi-band antenna according to claim 1, wherein, the first radiation main body further comprises a terminal end and is used for impedance matching; and the first radiation main body forms a first resonance path for transmitting the wireless signal having a first frequency.

5. The multi-band antenna according to claim 1, wherein, the second radiation main body forms a second resonance path; and the second resonance part of the second radiation main body comprises a first resonance sub-part and a second resonance sub-part.

6. The multi-band antenna according to claim 5, wherein, if the first resonance sub-part of a first resonance path is longer than the second resonance sub-part of a second resonance path, then the first resonance sub-part transmits the wireless signal having a frequency close to but lower than a second frequency; and the second resonance sub-part transmits the wireless signal having a frequency close to but higher than a second frequency.

7. The multi-band antenna according to claim 1, wherein, after the wireless signal is fed from the impedance matching circuit, the wireless signal is firstly fed to the second radiation main body and then fed to the first radiation main body.

8. The multi-band antenna according to claim 1, wherein, after the wireless signal is fed from the impedance matching circuit, the wireless signal is firstly fed to the first radiation main body and then fed to the second radiation main body.

9. The multi-band antenna according to claim 1, wherein, the impedance matching circuit increases a length of resonance path of the first and the second radiation main bodies.

10. The multi-band antenna according to claim 1, wherein, a travelling direction of the wireless signal on the first and the second radiation main bodies at least comprises four different directions.

11. The multi-band antenna according to claim 1, wherein, a part of the first ground plane is hollowed to expose the part of the insulation dielectric layer; and the first and the second radiation main bodies are disposed along at least three sides of the hollowed part of the first ground plane.

* * * * *